United States Patent [19]

Cinotti

[11] Patent Number: 4,811,544

[45] Date of Patent: Mar. 14, 1989

[54] FEED APPARATUS FOR STRIP WRAPPING MATERIAL, USED IN CONJUNCTION WITH A WRAPPING MACHINE OF THE TYPE WHEREIN THE COMMODITY TO BE ENVELOPED IMPINGES ON THE WRAPPING SHEET

[75] Inventor: Andrea Cinotti, Bologna, Italy

[73] Assignee: Wrapmatic S.p.A., Bologna, Italy

[21] Appl. No.: 119,146

[22] Filed: Nov. 10, 1987

[30] Foreign Application Priority Data

Nov. 11, 1986 [IT] Italy ..... 3570 A/86

[51] Int. Cl.[4] ..... B65B 41/02

[52] U.S. Cl. ..... 53/64; 53/389; 271/188; 271/272

[58] Field of Search ..... 53/389, 556, 203, 209, 53/64; 271/188, 272; 226/88

[56] References Cited

U.S. PATENT DOCUMENTS

| | | | |
|---|---|---|---|
| 3,355,166 | 11/1967 | Plumb | 53/389 X |
| 3,385,026 | 5/1968 | Schmermund | 53/389 X |
| 3,738,642 | 6/1973 | Blaire | 271/272 X |
| 3,921,803 | 11/1975 | Reed et al. | 53/389 X |
| 3,949,979 | 4/1976 | Taylor et al. | 271/272 X |
| 4,009,877 | 3/1977 | Ward, Jr. | 271/272 |

*Primary Examiner*—James F. Coan

*Attorney, Agent, or Firm*—Laff, Whitesel, Conte & Saret

[57] ABSTRACT

A feed apparatus for strip wrapping material, comprising two pairs of power driven, breasted belts which incorporate sets of transverse teeth offset one from the other and are looped around respective pulleys driven from the output shaft of a motor interlocked to monitoring and control means; the drive is stopped for a given interval each time the belts are indexed through a distance corresponding to the length of the wrapping sheet, thus ensuring that the sheet lies directly in the path of the oncoming commodity.

5 Claims, 1 Drawing Sheet

FEED APPARATUS FOR STRIP WRAPPING MATERIAL, USED IN CONJUNCTION WITH A WRAPPING MACHINE OF THE TYPE WHEREIN THE COMMODITY TO BE ENVELOPED IMPINGES ON THE WRAPPING SHEET

BACKGROUND OF THE INVENTION

The invention relates to a feed apparatus for strip wrapping materials, designed for use in a wrapping machine of the type wherein the commodity to be enveloped impinges on the sheet of material.

One of the wrapping techniques most exploited, for example, in the packaging of reams of paper or of commodities in roll format, involves urging the commodity to be wrapped against a sheet of paper or plastic wrapping material, whereupon the sheet is folded around the commodity.

One design of feed apparatus for strip wrapping material, as utilized in conjunction with a machine of the type employed to implement such a technique, comprises a supply roll, a pair of pinch rolls that uncoil the strip material from the roll, cutting means such as rotating blades, accelerating means, and finally, two pairs of power driven belt loops, located on either side of the wrapping path, which grip the longitudinal edges of the sheet between their breasted surfaces. The commodity is offered to the stationary material, say, by an elevator or an actuator, at a given point along the path, whereupon the wrapping operation is effected by the machine.

A critical moment in such a process is that in which the sheet of material is brought to a halt; the sheet must in fact be stopped with considerable precision, since the material will often be printed (with script and/or images), and the writing and/or design on the wrapped commodity must appear complete and unbroken.

In current embodiments, where the material is gripped as it is engaged by the commodity, the two pairs of belts turn continuously, and use is made of pressers that pin the sheet fast, retaining it such that relative sliding motion is induced between the material and the belts.

Apparatus of this type is somewhat lacking in precision, as there is no guarantee that the sheet will stop instantly when required.

Another problem with existing feed apparatus is that of limited operating speed, the effect of which is to compromise the competitiveness of the wrapping machine as a whole.

A further, and more serious problem, however, is that of ensuring precise and sure feed of the sheet of wrapping material, also, of guaranteeing its easy withdrawal from the belts at the moment when it is separated from them by the impinging commodity.

Faultless feed of the sheet of material might be ensured through increased frictional grip, obtained by the adoption of rubber faced belts. By contrast, to ensure an easier withdrawal of the sheet from the belts (in a direction at right angles to that of the belt grip) the degree of friction must be less so as to avoid its being torn by the impinging commodity, or at all events, being damaged to the point that the packaging operation is rendered fruitless.

Accordingly, the object of the invention is that of providing a feed apparatus capable of achieving the dual purpose aforedescribed in an economical and functional manner.

SUMMARY OF THE INVENTION

The stated object is achieved with an apparatus as described and claimed herein.

In the apparatus disclosed, the breasted faces of the belts are embodied with sets of transverse teeth offset longitudinally one in relation to the other; furthermore, the belts turn on pulleys that are driven by a motor interlocked to monitoring and control means by which rotation is caused to cease for a given interval each time the belts have been indexed through a set distance equal to the length of one sheet of wrapping material.

One of the advantages of the invention consists essentially in the constructive simplicity of feed apparatus embodied to the design disclosed.

Another advantage of the invention is the degree of precision achieved in positioning by virtue of the fact that the sheet is no longer brought to a halt by presser means which function in opposition to the means generating the feed motion, but rather, by the self-same means that produce the feed motion, namely, the belts with their transverse teeth.

A further advantage of the invention is that it ensures safe withdrawal of the sheet from the belts, inasmuch as the transverse teeth guarantee a solid grip in the longitudinal direction without pinching the sheet too tightly, and at the same time, permit easy extraction of the sheet when drawn away from between them at right angles to the longitudinal.

BRIEF DESCRIPTION of the DRAWINGS

The invention will now be described in detail, by way of example, with the aid of the accompanying drawings, in which.

DESCRIPTION of the PREFERRED EMBODIMENT

Figure 1:
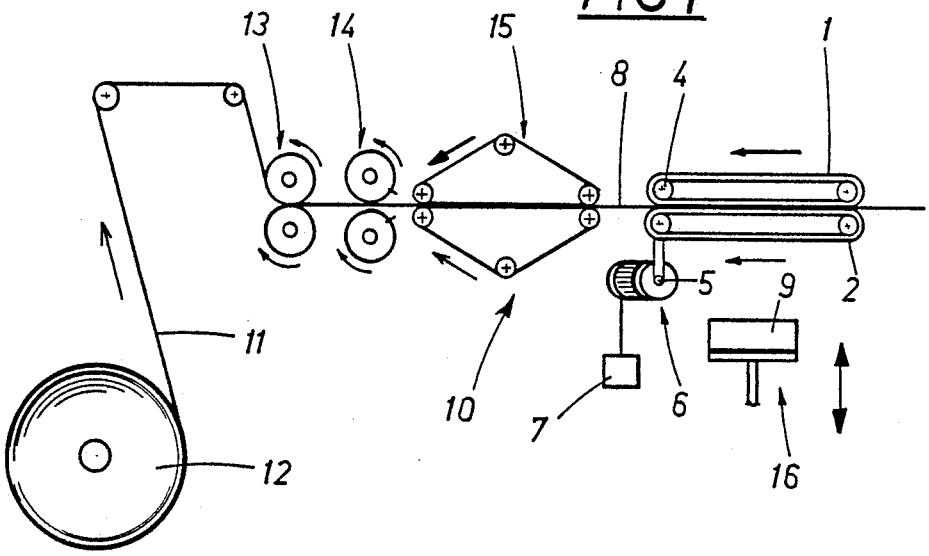
FIG. 1 shows the schematic representation of a feed apparatus according to the invention, viewed in side elevation.

With reference to FIG. 1, a feed apparatus for strip wrapping material according to the invention, denoted 10 in its entirety, comprises the following components, ranged along the path through which the strip 11 is taken: a supply roll 12, a pair of pinch rolls 13 by which the strip is uncoiled, means for cutting the strip, consisting in rotating blades 14, means for accelerating the cut strips consisting in paired power driven belt loops 15 the working faces of which are breasted together, and indexing means denoted 1 and 2.

In a preferred embodiment, the indexing means will consist in two pairs of breasted belts 1 and 2 looped around respective pulleys 4.

Figure 2:
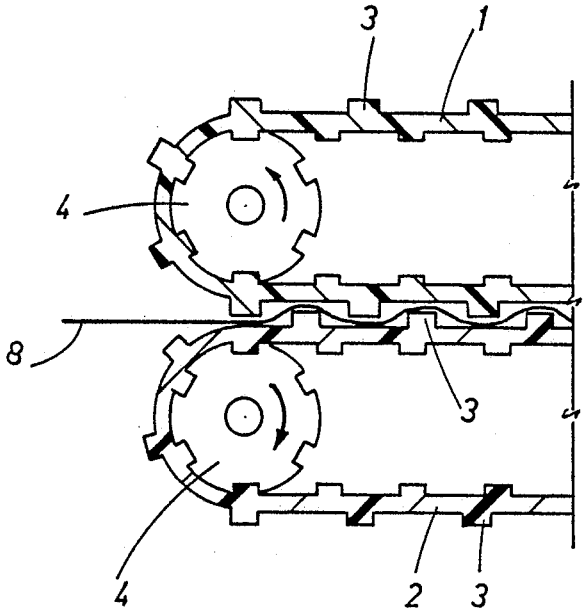
FIG. 2 shows a detail of the apparatus of FIG. 1 in enlarged scale, and more exactly, the belts by which the sheets of wrapping material are indexed.

In the feed apparatus 10 illustrated in FIG. 2, the external breasted surfaces of the paired belts 1 and 2 are embodied with transverse teeth, denoted 3; more exactly, the teeth of one belt are offset from those of the other, in such a way that the two sets are mutually interjacent and in a partial mesh, i.e. each tooth 3 penetrates the space between two given teeth of the other belt, though the teeth of the one belt never make contact with those of the other.

The internal surfaces of the two belts 1 and 2 and the periphery of the pulleys 4 likewise exhibit a toothed profile in order to ensure positive drive.

The driving pulleys 4 are coupled mechanically to the output shaft 5 of at least one motor 6. The motor is interlocked in operation to monitoring and control means denoted 7 (see FIG. 1), and will be a variable speed type; the variable speed facility is governed by the same monitoring and control means 7.

In a feed apparatus thus embodied, the discrete sheet 8 of wrapping material is propelled forward by the accelerating means 15 to the indexing belts 1 and 2; these grip the sheet and draw it forward to the point where it intercepts the trajectory of the oncoming commodity 9 (moving upwards in the example illustrated). Once the sheet 8 arrives at a given location, the motor 6 will shut off; in effect, the belts 1 and 2 are indexed through a given distance determined by the control means 7, and it is these that switch off of the drive, bringing the sheet 8 to a standstill. The commodity 9 is carried upwards, for example, by an elevator 16, and thus impinges on the sheet 8, which draws away easily from between the belts 1 and 2 along the length of the teeth 3, in a direction at right angles to the indexing path illustrated in the drawings.

The belts 1 and 2 will be interchangeable with others having teeth 3, at least, of different shape and dimensions; likewise, the distance separating the breasted surfaces will be variable to suit the material in which the strip 11 is manufactured.

The commodities 9 might be urged against their wrapping sheet 8 by a horizontal actuator rather than an elevator, in which case the apparatus would remain substantially unvaried as far as regards the disclosure, though the illustration of FIG. 1 would become a plan view, rather than a side elevation as stated above.

Such an arrangement is especially advantageous both for traditional wrapping paper and plastic film (e.g. polyester) with particularly good flexibility and low resistance t axial compression, and for tougher papers as well, since the corrugated effect produced by the interjacent breasted tooth profiles does not deform the material, if not elastically; rather, the belts provide a markedly high degree of grip in the longitudinal direction, and practically no grip whatever in the transverse direction.

What is claimed:

1. A feed apparatus for strip wrapping material, used in conjunction with a wrapping machine of the type wherein the commodity to be enveloped impinges on the wrapping sheet, comprising:

a pair of breasted power driven belts located along each longitudinal edge of the wrapping material, the breasted faces of which exhibit sets of transverse teeth offset one from the other in such way as to lie mutually interjacent, each tooth penetrating the space between two teeth of the opposite belt;

at least one motor, the output shaft of which is coupled mechanically to and drives the pulleys about which the belts are looped; and monitoring and control means, to which operation of the motor is interlocked, serving to stop the drive for a given interval each time the belts have been indexed through a set distance corresponding to the length of a discrete sheet of wrapping material, in order to enable faultless interception of the sheet by the commodity to be wrapped.

2. Apparatus as in claim 1, wherein the teeth of the breasted belts are never brought into mutual contact.

3. Apparatus as in claim 1, wherein the driving pulley around which each belt is looped is a timing pulley.

4. Apparatus as in claim 1, wherein the belts are interchangeable with others, of which at least the teeth are of different shape and dimensions, and the relative position of their breasted surfaces can be varied to suit the material from which the strip is manufactured.

5. Apparatus as in claim 1, wherein the motor is a variable speed type, and speed variation is governed by the monitoring and control means.

* * * * *